United States Patent [19]

Bjerkgard

[11] 4,009,762

[45] Mar. 1, 1977

[54] CONVERTIBLE LADDER-CARRIER VEHICLE ASSEMBLY

[75] Inventor: Bjorn Bjerkgard, Surrey, Canada

[73] Assignee: Lawrence Peska Associates, Inc., New York, N.Y. ; a part interest

[22] Filed: Apr. 28, 1976

[21] Appl. No.: 681,236

[52] U.S. Cl. ..... 182/20; 182/127; 280/30

[51] Int. Cl.[2] ..... E06C 1/397; E06C 5/00

[58] Field of Search ..... 182/20, 21, 127, 16, 182/23; 280/30

[56] References Cited

UNITED STATES PATENTS

| | | | |
|---|---|---|---|
| 535,082 | 3/1895 | Snell | 182/21 |
| 680,402 | 8/1901 | Van Court | 182/20 |
| 1,221,579 | 4/1971 | Olds | 280/30 |
| 3,104,889 | 9/1963 | Branch | 182/20 |
| 3,172,680 | 3/1965 | Hire | 182/21 |
| 3,430,972 | 3/1969 | Fiedler | 280/30 |

*Primary Examiner*—Reinaldo P. Machado
*Attorney, Agent, or Firm*—Joel Halpern

[57] ABSTRACT

A convertible ladder-carrier vehicle assembly includes a pair of parallel tubing elements connected by at least four transverse tubing elements. A second pair of tubing elements are positioned slidably within the first pair. Both pairs of tubing elements have aligned apertures. At least one resilient member having a hook element at each end is secured between the first pair of tubing elements detachably within the aligned apertures of the first and second pairs to thereby maintain the second pair of tubing elements in fixed relation to the second pair. A wheel assembly is detachably connected to each side of the first pair of tubing elements, journalled in intermediate transverse tubing elements.

8 Claims, 3 Drawing Figures

CONVERTIBLE LADDER-CARRIER VEHICLE ASSEMBLY

BACKGROUND OF THE INVENTION

The invention relates to convertible ladders and is more particularly of the type which is convertible to either an extension ladder or a step ladder and can also be used as a hand truck or dolly.

Convertible devices utilizable selectively as either a ladder or a hand truck or dolly have been known heretofore. U.S. Pat. No. 2,980,200 issued Apr. 18, 1961 to W. A. Kibby shows one such structure whereas U.S. Pat. No. 3,104,889 issued Sept. 24, 1963 to C. R. Branch, Jr. discloses another such structure. However, typical of the prior art devices of this character the structures are not utilizable as extension ladders, the overall length of the device when used as a handtruck limiting the ladder height. Of particular difficulty also, apparently, is the convertability of such structures into either a step ladder or an extension ladder.

SUMMARY OF THE INVENTION

It is one object of the invention to provide a convertible ladder-carrier vehicle assembly which is convertible into either an extension ladder, a step ladder or a hand truck.

It is another object of this invention to provide a convertible ladder-carrier vehicle assembly having wheel assemblies which are detachable and which, when removed, enables the device to be employed as a roof rack for a vehicle.

Other objects and advantages of the invention will become readily apparent from the following description of the invention.

According to the present invention there is provided a convertible ladder-carrier vehicle assembly comprising in combination:

a first pair of elongated parallel hollow metal tubing members having at least one set of opposed aligned apertures therein;

At least four transverse elongated metal elements connected in spaced parallel relation across the first pair of elongated members to thereby maintain the first pair of members in fixed spatial relation;

a second pair of elongated elements positioned slidably within the first pair of elongated members and having at least one set of opposed aligned apertures therein;

at least one transversely extending resilient attaching member having a hook element at each end thereof dimensioned to fit within the sets of apertures to thereby secure the second pair of elongated elements in fixed position relative to the first pair of elongated members;

and a pair of wheel assemblies detachably journaled in the opposed ends of intermediate ones of the transverse elongated elements.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
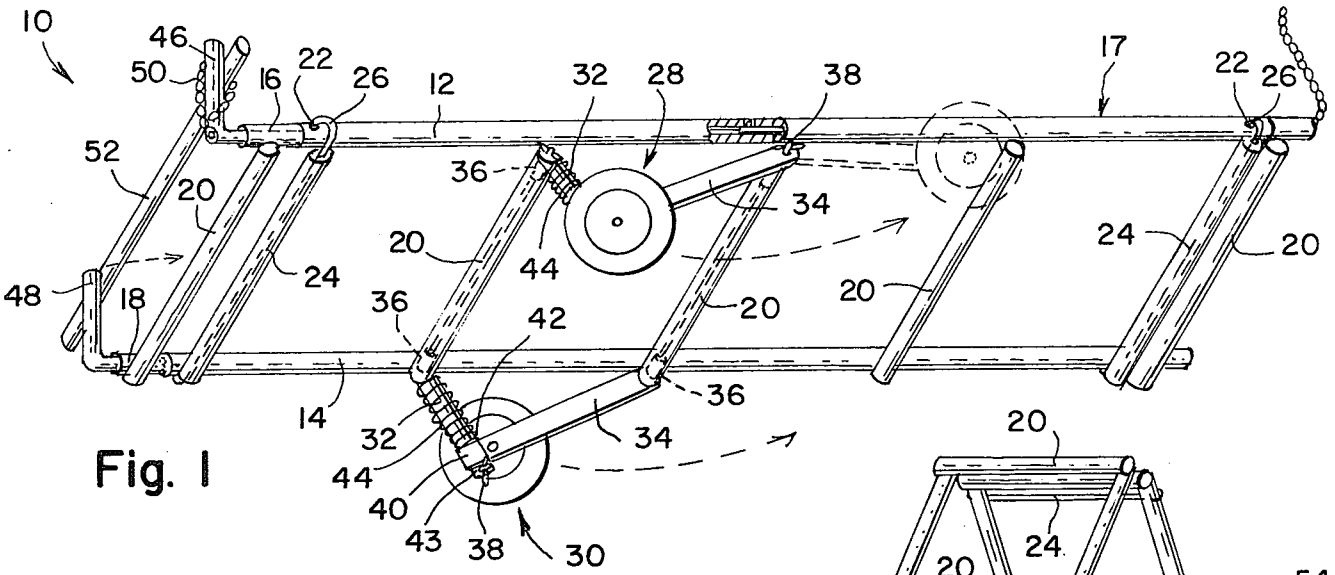
FIG. 1 is a perspective view of the convertible ladder-carrier vehicle assembly of the invention in its assembled state utilizable as a hand truck or dolly.

Referring to the drawings there is shown generally, by reference numeral 10, a convertible ladder-carrier vehicle which embodies the features of the invention. The structure includes a pair of elongated tubing members 12, 14 which are disposed in parallel relation. Preferably the tubing is metal such as aluminum or steel. The tubing is hollow to permit the storage therein of a second pair of elongated tubing elements 16, 18. A plurality of transverse elements 20, desirably at least four of such elements, are secured across members 12, 14 and, when the structure is employed as a ladder these transverse elements serve as the steps. At least two of the intermediate transverse elements are provided with hollow end portions or are hollow tubes throughout in order to accommodate mounting of the wheel assemblies as will be hereinafter described. Preferably the transverse elements 20 are permanently connected across the undersides of the pair of members 12, 14 such as by welding. Thus, by virtue of the permanent securing of the transverse elements to members 12, 14 a rigid load-supporting framework 17 is formed.

A second pair of elongated tubular elements 16, 18 are dimensioned to fit slidably within members 12, 14 for storage therein. Each of the tubing members 12, 14 16, 18 is given at least one aperture 22 such that when elements 16, 18 are positioned within members 12, 14 the apertures can be brought into alignment and the inner and outer tubular members secured together by means of one or more transversely extending resilient connecting member 24. The connecting member is provided at each of its opposed ends with a hook element 26 insertable into the aligned apertures to detachably connect the respective pairs of tubular members.

Figure 2:
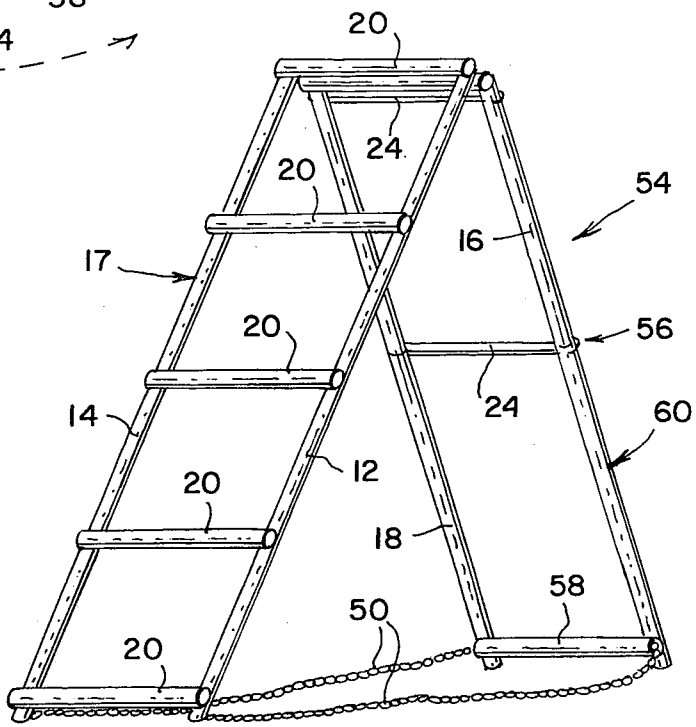
FIG. 2 is a perspective view of the structure shown in FIG. 1 with the wheel assemblies removed and utilizable as a step ladder.

A pair of wheel assemblies 28, 30 is detachably connected to the framework 17 so that the structural assembly may be employed as either a dolly or a hand truck. As shown in FIG. 1, each of the wheel assemblies includes a pair of arms 32, 34. One end of each arm is given a bushing 36 which is dimensioned to fit slidably within the hollow end of one of the transverse elements 20. The bushings are preferably welded to the associated arm. By means of apertures in the bushing and the transverse elements a spring clip 38 can be inserted to afford a detachable connection. It will be observed also that one of the arms 32 of each pair is provided with a bracket 40 having a slot 42 therein adapted to slidably receive an end of the other arm 34. An aperture 43 is formed in the arm 32 and a spring clip 38 is inserted therein to detachably connect the arms. Thus, the wheel assemblies can be readily attached to framework 17 where the assembly is intended to serve as a carrier vehicle, i.e., as a hand truck or dolly or, the assemblies can be readily detached from the framework when the assembly is to be employed as a step ladder (as shown in FIG. 2) or in any situation where the wheel assemblies might interfere with the utility of the device. It will be observed further, from FIG. 1, that a spring 44 is mounted on arm 32 to afford some degree of resiliency when the assembly is employed as a vehicle. This has been found to be of particular value when the assembly is utilized as a dolly for the transport, for example, or a small boat in tow of an automobile. The wheel assemblies, constructed as described above have been found suitable for the transport of loads up to 400 pounds.

A pair of 90° angle elements 46, 48 are insertable into the ends of tubular elements 16, 18 and are dimensioned to be rotatable therein. Such angle elements are useful in connection with the utility of the assembly as a roof rack for an automobile or as an end retainer element when the assembly is used as either a dolly or hand truck. Each of the angle elements is desirably formed with a pair of aligned apertures so that the angle elements can be locked to the tubular members within which they are positioned.

Desirably, a chain 50 is provided on each of tubing elements 16, 18 and have been found useful in connecting the assembly to the rear of an automobile, trailer or the like for the towing of a boat or other loads where the assembly serves as a dolly. As shown in FIG. 1 the assembly can be detachably connected to a structural element 52 of a roof rack on a motorized vehicle by means of the chain when this is considered desireable. Such interconnection can serve the purpose of storing the assembly of the invention during transit or of increasing the storage capacity of the roof rack.

When the assembly is to be employed as an extension ladder the second pair of tubing elements 16, 18 are withdrawn from the outer tubing members 12, 14 until the sets of apertures are in alignment. One of the connecting members 24 can then be employed to secure the pairs of tubing members together by insertion of the hook elements into the aligned apertures. An extension ladder of approximately 10 feet in length can be formed in this manner.

As depicted in FIG. 2, the assembly can be employed as a step ladder 54 by completely withdrawing the pair of tubing members 16, 18 from their storage position within tubing members 12, 14. A connecting member 24 is employed to secure the framework 17 to the elongate tubing elements 16, 18 at the top of the step ladder, and a second connecting member is utilized at an intermediate location 56. It will be observed that a transverse tubing member 58 is connected across the ends of the pair of elements 16, 18 and such transverse member serves as a base for the step ladder extension 60. Chains 50 are utilized to limit the extent of separation between the pairs of tubing members.

Figure 3:
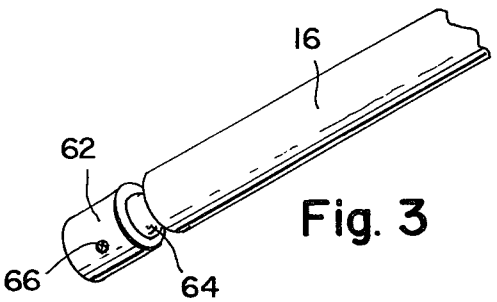
FIG. 3 is a fragmentary perspective view of the end portion of one of the elements showing a modification in structure which is especially adapted to convert the assembly into a step ladder.

FIG. 3 depicts a modified form of end construction for inner tubing elements 16, 18. As shown each of elements 16, 18 is provided with an end section 62 which is pivotably connected to the remainder of the tubing element such as by means of a ball and socket joint 64. The end sections are also provided with aligned apertures 66. Thus, when the assembly is to be employed as a step ladder, tubing elements 16, 18 are withdrawn from their storage position within members 12, 14 and the elements are connected to members 12, 14 by insertion of the end sections 62 in the upper ends of members 12, 14. A pivotal upper connection is thus formed, and the use of a connecting member 24 with the hook elements inserted through the aligned apertures in the end sections 62 and corresponding apertures in members 12, 14 affords a secure connection.

From the foregoing description of the invention it will be seen that an assembly has been provided which can be rearranged in a variety of constructions, utilizing the basic framework 17, so as to afford a versatile convertible ladder-carrier vehicle structure that is simple in basic structure.

I claim:

1. A convertible ladder-carrier vehicle assembly comprising in combination:

a first pair of elongated parallel hollow metal tubing members having at least one set of opposed aligned apertures therein;

at least four transverse elongated metal elements connected in spaced parallel relation across said first pair of elongated members to thereby maintain said first pair of members in fixed spatial relation;

a second pair of elongated elements positioned slidably within said first pair of elongated members and having at least one set of opposed aligned apertures therein;

at least one transversely extending resilient attaching member having a hook element at each end thereof dimensioned to fit within said sets of apertures to thereby secure said second pair of elongated elements in fixed position relative to said first pair of elongated members;

and a pair of wheel assemblies detachably journalled in the opposed ends of intermediate ones of said transverse elongated elements.

2. A convertible ladder-carrier vehicle according to claim 1, wherein each of said second pair of elongated elements is provided with an end section which is pivotably connected to the remaining portion of the elongated element.

3. A convertible ladder-carrier vehicle according to claim 2, wherein a through aperture is provided in each of said pivotable end sections.

4. A convertible ladder-carrier vehicle according to claim 1, wherein said first and second pairs of elongated members and elements respectively are provided with a set of opposed aligned apertures adjacent the ends thereof.

5. A convertible ladder-carrier vehicle according to claim 1, including a 90 degree angle element slidably positioned in the ends of said second pair of elongated elements.

6. A convertible ladder-carrier vehicle according to claim 1, including a chain element secured to the ends of at least one of said second pair of elongated elements.

7. A convertible ladder-carrier vehicle according to claim 1, wherein each of said wheel assemblies includes a pair of arms, one end of each of said arms being provided with a bushing slidably and detachably connected in the ends of said intermediate transverse elements, the arms being interconnected adjacent their other ends, and a wheel element is journalled in one of said arms.

8. A convertible ladder-carrier vehicle according to claim 7, including a coil spring connected between said one end of one of said arms and the transverse element to which such arm is connected.

* * * * *